United States Patent [19]

Bohorquez et al.

[11] 4,301,709

[45] Nov. 24, 1981

[54] MECHANICAL ANTI-HANGFIRE SYSTEM

[75] Inventors: Luis A. Bohorquez, Inglewood; Michael M. Cleary, Pacific Palisades; Charles C. Ash, Los Angeles; Don E. Van Osten, Fountain Valley; Robert B. Pounds, Santa Monica; John H. Sallach, Sepulveda, all of Calif.

[73] Assignee: Hughes Helicopters, Inc., Culver City, Calif.

[21] Appl. No.: 46,664

[22] Filed: Jun. 8, 1979

[51] Int. Cl.[3] ..... F41D 11/00

[52] U.S. Cl. ..... 89/11

[58] Field of Search ..... 89/9, 11, 12, 13 R, 89/13 A

[56] References Cited

U.S. PATENT DOCUMENTS

| | | | |
|---|---|---|---|
| 1,216,938 | 2/1917 | Brotherston | 89/11 |
| 4,154,143 | 5/1979 | Pechamat et al. | 89/11 |

*Primary Examiner*—Stephen C. Bentley

*Attorney, Agent, or Firm*—Smyth, Pavitt, Siegemund & Martella

[57] ABSTRACT

A hangfire protection system for an externally powered gun includes a recoil sensing mechanism cooperating with a sear latching mechanism such that in the event of a hangfire, a sear engages a safety link on the chain drive assembly to keep the bolt locked. If the round fires, gun function continues; if the round does not fire there is a delay of a sufficient time to assure that the round is a dud, and it is ejected. The details of the mechanical hangfire protection system are described.

20 Claims, 11 Drawing Figures

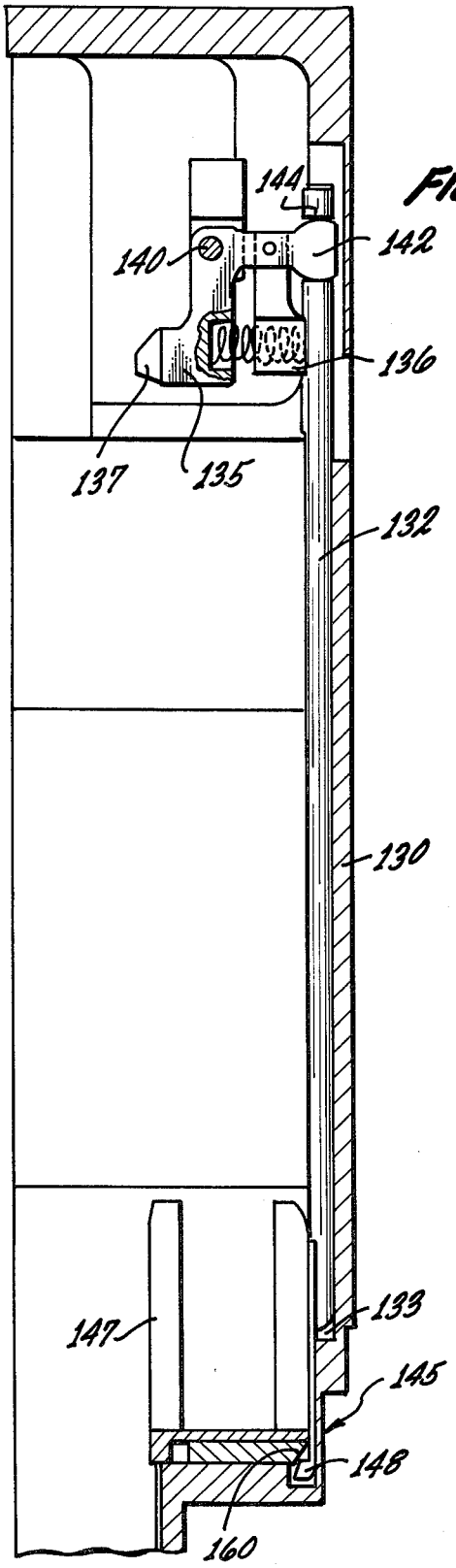
Fig. 10
Fig. 11
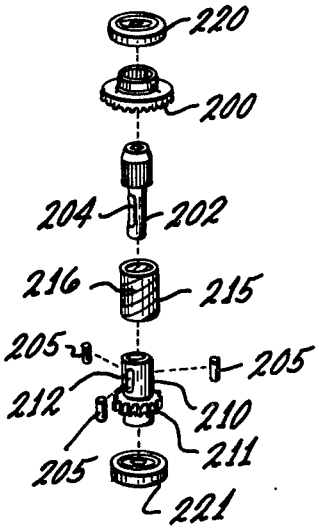

MECHANICAL ANTI-HANGFIRE SYSTEM

BACKGROUND OF THE INVENTION

The present invention relates to a hangfire protection system and more particularly to an improved completely self-contained hangfire protection system for a gun having a relatively high rate of fire.

In many gun systems, the sequence is ramming, locking, firing, unlocking and extracting and feeding. In powered guns, such as those externally powered, the cycle continues even though the round has not fired. While this eliminates the possibility of gun stoppage due to a misfire, it does create a potentially hazardous situation.

Sometimes a round of ammunition does not fire properly, within the design limits of the ammunition, because of some unknown defect in the ammunition. Normally, a round fires within a prescribed time limit after the primer is struck, usually measured in milliseconds. When the primer of a round is struck, and the round fails to fire within the prescribed time limits, the round either fires late within an extended time limit, a hangfire, or does not fire at all and is a dud. Duds, which are not potentially dangerous, can be extracted and safely disposed of with relative ease.

A hangfire, on the contrary, presents a far more hazardous condition to the gun crew especially if the round is within the time limit which is greater than what experience or data has indicated to be the maximum interval within which the round normally fires.

For relatively high rate of fire weapons, powered through a repeating sequence, a hangfire can be quite dangerous since the lock-fire-unlock sequence is fairly short, and may be shorter than the maximum interval of hangfire. The result is that the round may be extracted while it is still possible for the round to go off with resulting personnel or gun damage, or both.

Hangfire should be distinquished from "cook-off", the latter a condition in which barrel or breech heat detonates the round without the primer being struck and which involves time periods substantially longer than those involved in hangfire. Cook-off is usually avoided by controlling normal gun shut-down so that the bolt is in the open bolt condition.

SUMMARY OF THE INVENTION

In accordance with this invention, a hangfire protection system is provided which precludes a hangfire by delaying extraction until the round in the chamber has fired or is beyond the interval during which hangfire can occur, i.e. the round is a dud.

Thus, in an externally powered gun, such as herein described, a chain drive mechanism is used to reciprocate the bolt through the ram, lock fire, unlock, extract and feeding cycles. The dwell period for the lock, fire and unlock sequence is shorter than the maximum hangfire interval so that it is possible, without the present invention, to have a potentially dangerous hangfire.

By the present invention, a mechanical self-contained system is provided which responds to the absence of gun recoil, i.e. the failure of the round to fire, to maintain the bolt in the locked position for a safety period substantially in excess of the maximum period for hangfire. After the safety period has passed, and the round is deemed a dud, the gun sequence continues with the dud being ejected as a spent casing. Should the "hangfire" detonate within the maximum time interval, gun function continues as if no hangfire occurred.

In brief, the hangfire system of this invention senses gun recoil, indicating the round has fired, to delatch an interlock system thus permitting continued gun function. If there is no recoil, the latched interlock system remains latched and the bolt remains locked until the interlock is delatched whether manually, or electrically through a stop-start sequence, that is, the normal cease fire and restart sequences. The delay between the stop-start sequence, whether manual or electrical, is longer than the maximum hangfire interval, and the round is ejected as a dud.

The interlock system is then related between the unlocked and lock sequence for the next round.

Thus, by the present invention a relatively simple and reliable hangfire interlock is provided and which functions to prevent extraction of a round until sufficient time has passed such that it is established that the round is a dud.

The principal advantages of the present hangfire system are that it is mechanical and self contained as part of the gun. If no hangfire occurs, gun function continues normally. If a hangfire does occur, gun function ceases long enough for the round to fire, at which time gun function automatically continues.

Further, the mechanical interlock system offers the advantage that its operability can be checked by dry cycling the gun. If fully functional, then in dry cycling the gun function stops, before breech unlock as an indication that the interlock system is functional. If in dry cycling the gun function continues, then there is some problem in the interlock system.

It will be apparent to those skilled in the art, after they have read the following description, that there are advantages, modes and uses that will be readily understood and apparent from the following detailed description and accompanying drawings which illustrate what are considered to be preferred forms of the present invention as set forth in the appended claims.

BRIEF DESCRIPTION OF THE DRAWINGS

FIG. 10 is a side view, partly in section and partly in elevation, of the mechanical interlock system of the present invention; and FIG. 11 is a developed view of a clutch assembly used in a gun incorporating the present invention.

DETAILED DESCRIPTION OF THE INVENTION

Figure 1:
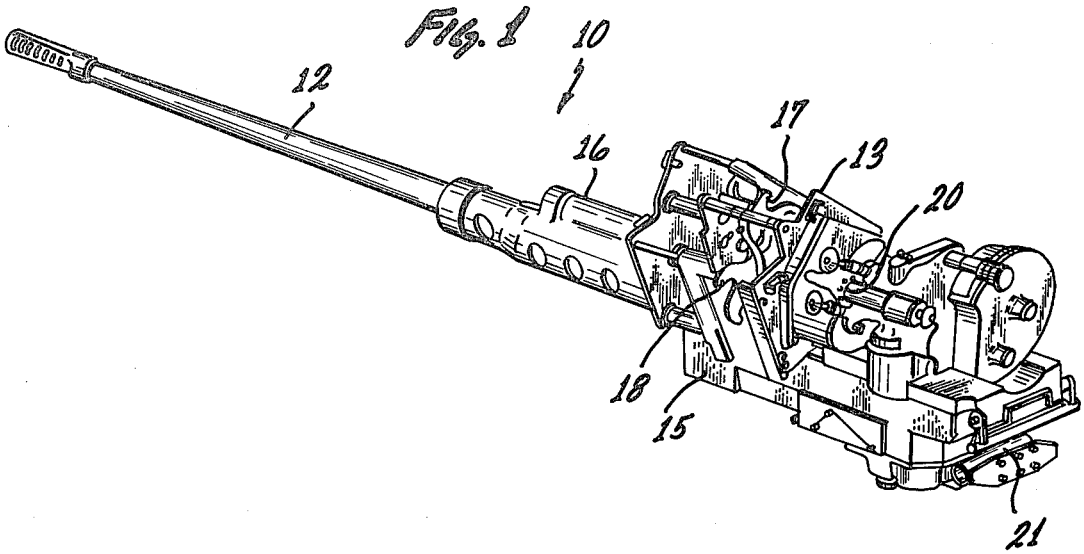
FIG. 1 is a view in perspective of a gun incorporating the present invention.

Referring to FIG. 1, a preferred form of the gun 10 is illustrated, although it is understood that the gun may take other forms as have been described, see for example Ser. No. 789,502, filed on, Apr. 21, 1977 and assigned to the same assignee.

As illustrated, the gun 10 includes three major subassemblies, a barrel 12, a gearbox feeder assembly 13 weighing 32 Kg. and a receiver assembly 15, weighing 42 Kg. In the form illustrated, a 25 mm gun is shown having an overall weight of 104 Kg and an overall length of 2743 mm. The rate of fire is single shot, 100, 200 or 475 shots per minute depending on mode and drive motor size.

The barrel 12 which is 2032 mm long and which weights 40 Kg is locked into the breech (FIG. 4) which is part of the forward end of the receiver assembly 15. Mounted on the forward end of the receiver assembly is a recoil spring and damper assembly 16 which along with the barrel 12 move rearwardly about 0.7 inches maximum in recoil.

In the form illustrated, the gun 10 includes a dual feed system including separate upper sprocket 17 and lower sprocket 18 one of which is operative to present a round to an intermittently driven transfer rotor (not shown) for presentation to the bolt located within the receiver assembly 15. Selection of either the upper or lower feed sprocket is by a clutch system 20.

The gun is externally powered through a 1.5 Hp 24 volt DC motor 21 with a nominal speed of 7700 rpm mounted on the lower under portion of the receiver 15. Through a series of gears, as will be described, the motor provides power and the basic rate of fire timing function of the gun.

Figure 2:
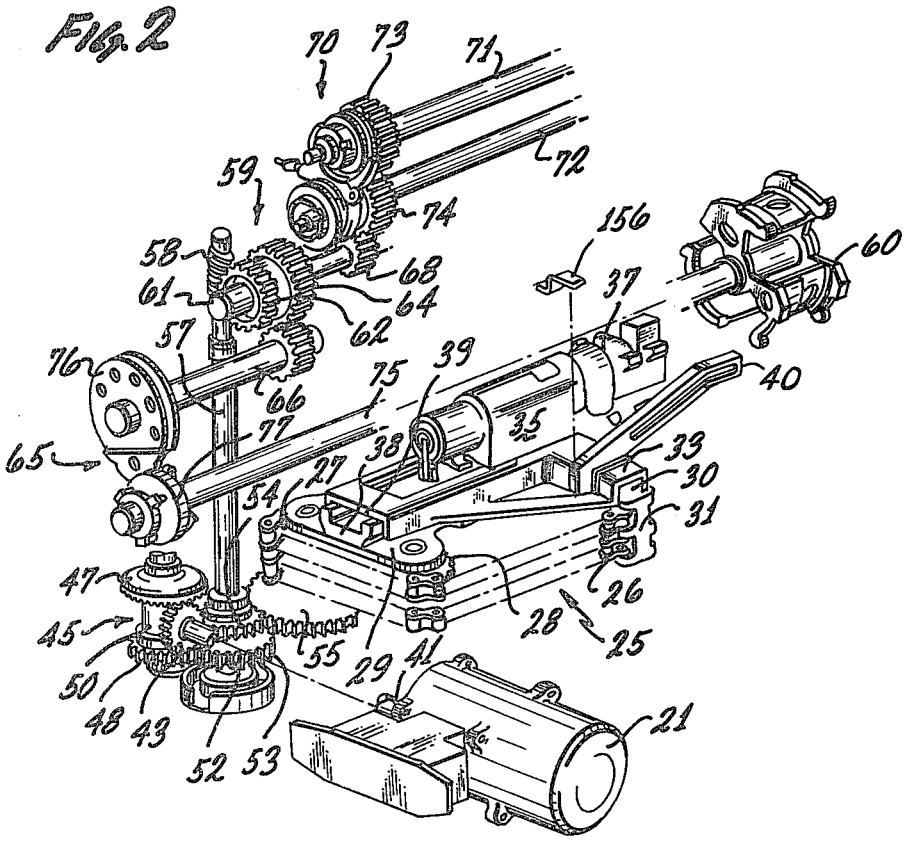
FIG. 2 is a view in perspective of portions of a gun incorporating the present invention.

The heart of the gun is a chain drive mechanism 25 as illustrated diagrammatically in FIG. 2 and which includes a length of double row $\frac{5}{8}$ inch pitch roller chain 26 which cycles in a racetrack pattern on four sprockets, one 27 driven and three idlers 28 supported in a track 29. A bolt drive slider 30, fixed to a master link 31 of the chain 26 and acting in a traverse slot 33 on the underside of a bolt carrier 35, converts rotational chain motion to reciprocating motion of a bolt 37 on the track, the latter including a surface track 38 cooperating with a slide 39 on the underside of the carrier. The slot 33 for the slider 30 extends transversely across the carrier 35. Also carried on the carrier 35 is a forward eject finger 40.

Connected to the rotating drive shaft 41 of the motor 21 is a pinon gear 43 which drives a clutched gear assembly 45. The clutched gear assembly, the details of which will be described, includes an upper bevel gear 47 driven by the pinon gear 43, the bevel gear driving a lower gear 48 through a clutch 50. Cooperating with the clutched gear assembly 45 is a chain drive and worm gear assembly 52 including a lower gear 53 driven by gear 48 and an intermediate gear 54 splined to be driven with 53. The intermediate gear 54 drives a chain drive assembly gear 55 splined to gear 27 to drive the chain 26. All of the gears and shafts are supported by bearings, as is well known.

Forming part of the chain drive and worm gear assembly 52 is a drive shaft 57 having a worm 58 on the end and operating through a gear train 59 to drive the infeed sprocket assemblies 17 and 18 and a feed rotor assembly 60 (partly shown). The worm 58 drives a transfer shaft 61 through transfer gear 62, the shaft having a drive gear 64 for an indexing drive assembly 65 driven by a shaft 66. Also affixed to shaft 61, as shown, is a smaller drive gear 68 which drives one or the other, but not both of the sprocket assemblies 17, 18 through a gear and clutch assembly 70, shaft 71 driving the upper sprockets 17 and shaft 72 driving the lower sprockets 18.

The clutch and gear assembly 70 includes a pair of constant mesh gears 73 and 74 driven by gear 68, the constant mesh gears driving one or the other of the upper or lower sprockets through a double acting clutch in the form of a single-tooth ratchet clutch which provides timing with the sprocket which is being driven. The feeder controls 20 are as described. Thus, in normal gun operation either one or the other of shafts 71 or 72 is rotated to drive continuously, and at a speed controlled by the motor and gearing, one or the other of the upper or lower feed sprockets, i.e. once the upper or lower mode is selected, the gun will continue in that mode until a switch is made.

The indexing drive assembly 65 is a paradromic indexing mechanism sometimes referred to as an intermittent drive system, in which shaft 66 is continuously driven. Shaft 66 cooperates with shaft 75 connected to the feed rotor 60 through the intermittent drive to rotate the feed rotor 60 one-third of a revolution for each shot of the gun.

One end of shaft 66 includes a Fergerson cam 76 driven at a constant velocity, cam 76 cooperating with cam 77 on shaft 75 to effect intermittent rotation of the rotor 60. The cams 76 and 77 are timed to a dwell of 276 degrees for cam 77 and by an 84 degree index for feeding.

Figure 3:
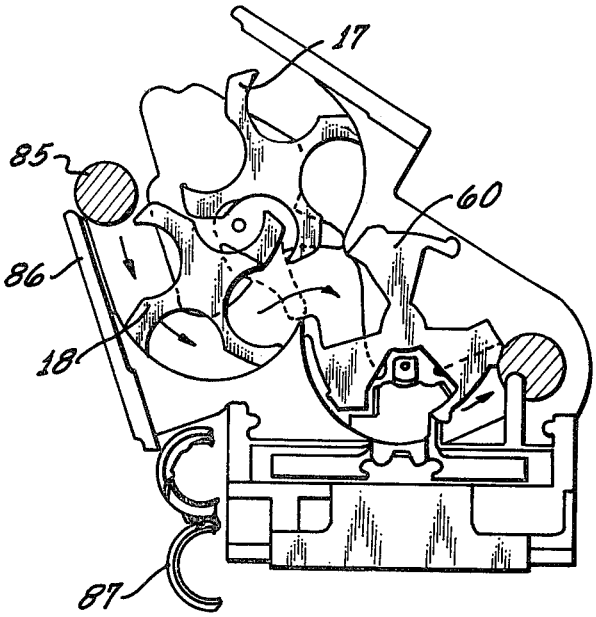
FIG. 3 is a diagrammatical view of the infeed mechanism of a gun incorporating the present invention.
Figure 4:
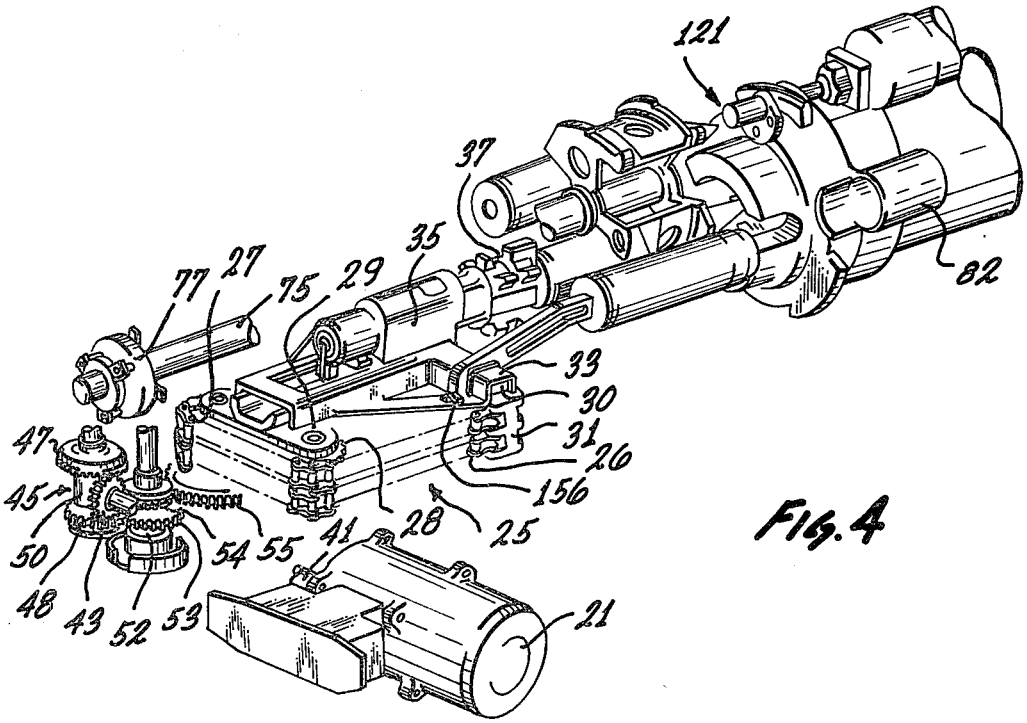
FIG. 4 is a view in perspective, similar to FIG. 2, but showing more of the details of a gun incorporating the present invention.

Referring now to FIGS. 2–4, the overall gun operation may be understood. In the normal shut-down mode, the carrier and bolt are in the rearward position with the master link located slightly forward of the centerline of the drive sprocket 27; with the spent casing held on the front face of the bolt. When motor 21 is energized, several events are started: the selected feed sprocket assembly is driven and the chain 26 is driven. There is a slight rearward movement of the carrier as the master link traverses around the drive sprocket thus bringing the carrier and bolt to the rearwardmost position. As the master link 31 moves laterally, the carrier and bolt are stationery and the slide 30 moves laterally through the transverse slot 33.

During the rear dwell of the bolt, the feed rotor 60 starts to index, initially slowly, then reaches a maximum speed, then gradually slows to a stop in a one-third revolution, in a sinusoidal acceleration mode. During indexing of the feed rotor, the feed rotor land moves the spent casing in front of the forward eject finger 40 (see FIG. 4) and places a new round at the bolt face. At the same time, the infeed sprockets, which move at constant velocity, have presented a new round to the available empty feed rotor cavity.

At approximately this point, the master link 31 starts moving around the first idler sprocket 28 and the carrier and bolt start to accelerate slowly towards the breech in the start of a ramming sequence. The transition in master link travel from lateral to axial travel represents a gradual, smooth slow start of the bolt forward, with increasing speed of travel as the master link approaches axial movement, the latter representing the maximum forward speed of the carrier and bolt, the bolt drive slider 30 being in the right most position of the carrier slot 33. As the carrier and bolt reciprocate forward, the round in the bolt face is rammed and the spent casing is ejected out a forward eject port 82. During this movement of carrier and bolt by the continually moving chain 26 and master link, the infeed sprockets are continuously moving but the feed rotor 60 is stationary. It is to be understood that ejection of the spent casing may be out the side or in other ways.

As the master link approaches the end of its axial movement forward and starts to turn around the right front idler sprocket 28 (as seen in FIG. 4), the movement of the carrier and bolt gradually decelerate and the slider 30 moves right to left in lateral movement in the carrier slot 33. During this phase, the carrier and bolt are stopped, and the bolt is locked in the breech and the round fired. The infeed sprockets are still driven as is the chain but the rotor 60 is stationary. As the master link makes the transition from lateral to rearward axial movement to the rear, around the front left idler sprocket, the bolt is unlocked and the carrier and bolt accelerate gradually to the rear, reaching maximum rear speed as the master link starts axial rear movement. The spent casing is carried rearwardly on the bolt face and as the master link approaches the drive sprocket 27, the sequence repeats itself.

As is apparent from the description thus far, the generally racetrack movement of the chain provides alternately axial and lateral movement of the slider and reciprocating movement of the carrier and bolt. The axial motions cause bolt movement fore and aft while the lateral motion of the slider provides free travel through the carrier slot. The free travel provides appropriate dwell time for firing and feeding at the fore and aft ends of the cycle. Further, during the relatively long firing dwell, the bolt remains locked, thus permitting barrel pressure to return to ambient and assuring essentially zero gas flow into the receiver and upon bolt unlock. Also, the system of sprockets and chain act to accelerate the bolt smoothly, move it at constant velocity and then decelerate it smoothly.

Referring now to FIGS. 3 and 4, the gun of the present invention provides for 100% round control. The infeed sprockets interfaces with the reciprocating bolt assembly through the intermittently driven feed rotor 60. As shown in FIG. 3, where the lower feed sprocket 18 is engaged, the feed sprocket powered by the gun drive motor, as described, brings ammunition 85 into the gun at constant velocity through a pair of link strippers 86 (one being shown). The feed sprockets are compact four tooth units which provide positive engagement of the ammuniton belt. As the cartridges are stripped, the links 87 drop away and the cartridge is guided out of the feed sprocket and placed successively into the present cavity of the feed rotor 60, the latter provided with three cavities at 120 degree orientation, as shown. The feed rotor is stationary while the bolt rams, fires and extracts the previous round, the feed rotor motion being effected as previously described through the intermittent indexing mechanism. The movement of the rotor is that of controlled acceleration, constant velocity and controlled deceleration. Simultaneously the feed rotor sweeps the fired casing out of the bolt and presents the new round from the feed sprocket into the bolt face.

The feed rotor operates as the means to pass the cartridge from the feed sprocket to the bolt face. The rotor 60 contains three cavities, uniquely shaped, as illustrated in FIG. 4. Each cavity has a basic diameter which matches the case diameter, with reliefs cut into them to clear the locking lugs, as shown, on the bolt. Since all gun motions which act on the round are smoothy generated, there are no impacts.

With this background, one can understand the improvement of the present gun over that described in Ser. No. 789,502 supra, in the provision of a unique safety interlock system to eliminate the hazard associated with hangfires. As will be described, the normal gun shut-down sequence is in the open bolt position, through the action of a sear and master link. The hangfire safety system operates on the basis that the gun must experience recoil for firing to continue, otherwise a safety link on the chain is stopped by the sear while the bolt remains locked. To resume firing, the gunner releases the trigger and restarts gun operation.

In the gun described the elapsed time of the "stop-start"sequence is about 500 milliseconds. The data to date indicates that the maximum hangfire for any known 25mm ammunition is in the order of 150 milliseconds. Since the firing dwell (firing pin fall to bolt unlock) of the described gun is 51 milliseconds for a rate of 200 shots per minute, the added 500 milliseconds delay provides for between 550 and over 600 milliseconds of safe bolt lock time to ensure hangfire safety for the gun.

In the case of higher rates of fire, 500 shots per minute, the firing dwell decreases to 19 milliseconds. Nonetheless, the hangfire is usually less than 15 milliseconds, with the 150 milliseconds figure being a "worst case"-number. Thus, even though there may be a hangfire for failure of the round to clear the gun in the 3–6 millisecond interval of normal ammunition firing, the firing dwell is long enough for most technical hangfires, however, for longer hangfires, the system works well.

Figure 7:
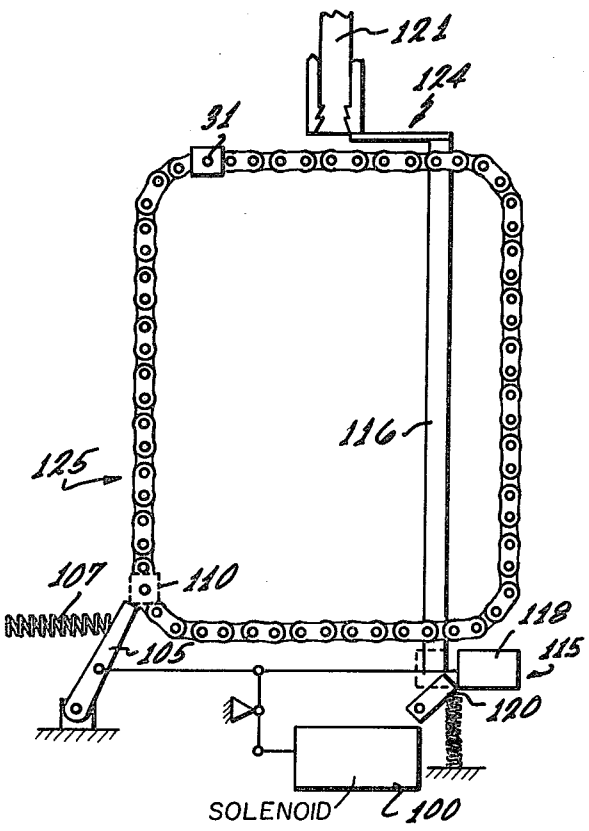
FIGS. 5–7 are schematic views, for purposes of explanation; illustrating the functional operation of the mechanical interlock system of the present invention.
Figure 6:
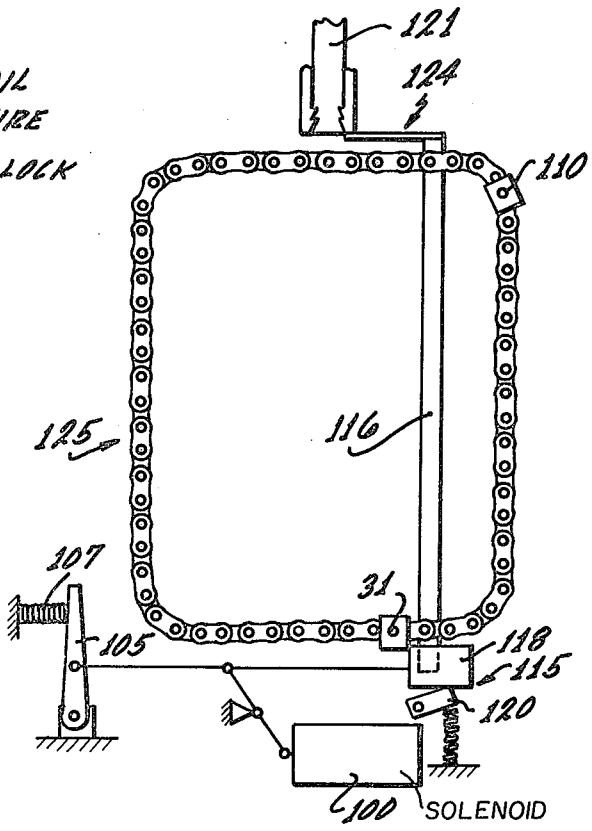
Figure 5:
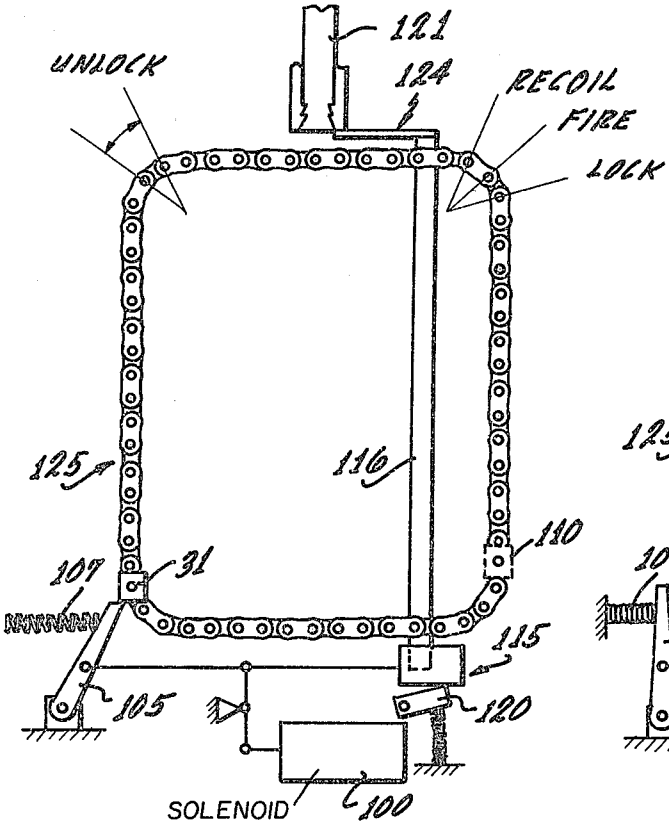

The system for hangfire protection is diagrammatically illustrated in FIGS. 5–7. As shown in FIG. 5 the gun is in the normal open bolt shut-down mode. A sear solenoid 100 is de-energized (i.e. extended position) and a sear 105 is biased by a spring 107 against the master link 31 which is positioned in travel just forward of the centerline of the drive sprocket. FIG. 5 also illustrates; the points in master link travel approximately where the bolt lock, fire, recoil and unlock sequence takes place in relation to the position of the master link position. Forward of the master link 31 with respect to the direction of chain movement is a safety link 110. A recoil latch 115 is in the unlatched position and a recoil pushrod 116 is in the static, non-recoiled position.

As shown in FIG. 6, gun action has just started. The solenoid 100 is energized (i.e. retracted position) and the sear 105 is de-energized permitting the chain to move. The recoil latch 115 is about to be set by movement to the right of a recoil latch foot 118. After sufficient movement of the latch foot, the latch 120 is spring loaded into place. As the latch is being latched (see FIG. 7), the solenoid 100 is over-powered and the sear is positioned to pick up the safety link.

If the chambered round properly fires, the barrel and breech 121 recoil moving the recoil latch 120, through the pushrod 116, releasing the foot 118 so that the sear is retracted by the solenoid which is still energized as described in connection with FIG. 6. After firing, however the master link is at the position of about 124 and the safety link is at position of about 125. If, however, there is a hangfire, there is no recoil, the pushrod fails to move to release the foot and the sear engages the safety link 110 before the unlock position is reached, as shown in FIG. 7, to halt chain movement before the bolt unlocks.

Since the latch mechanism works against the action of the solenoid, de-energizing the solenoid permits the sear spring to hold the safety link, allowing the latch to delatch, with the parts as seen in FIG. 5, except that the sear engages the safety link 110 rather than the master link. When the solenoid is energized some 500 plus milliseconds after the hangfire, the parts are in the position as shown in FIG. 6 except that the safety link 110 has passed the sear and the master link is starting axial rearward movement to carry the bolt to the rear. Should a shut-down sequence now occur, the sear engages the master link because the solenoid is de-energized.

In the absence of a hangfire, the latch is reset by a reset cam carried on the bolt carrier and which trips a finger in the latch mechanism.

Figure 8:
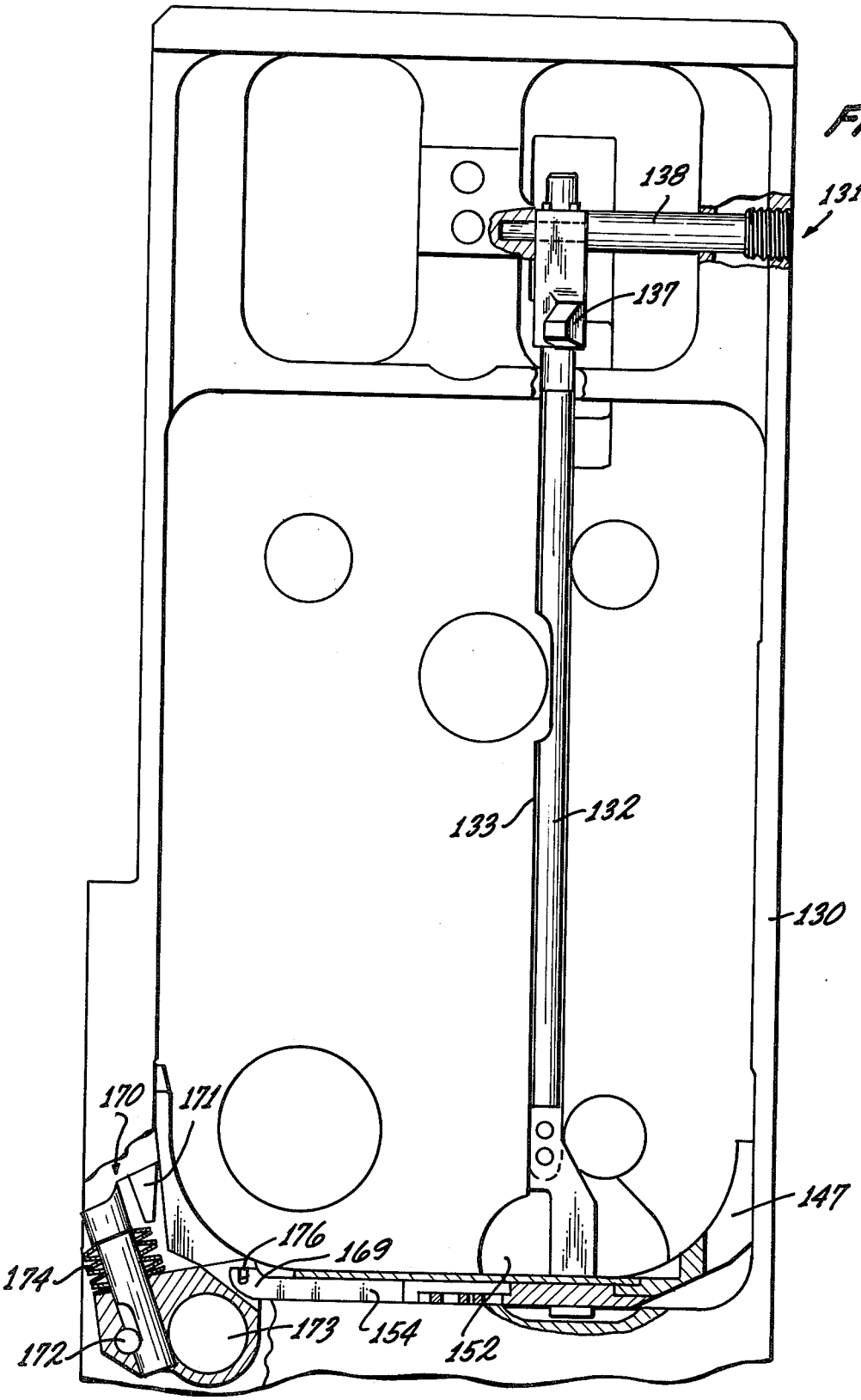
FIG. 8 is a plan view, partly in section, illustrating the components of the mechanical interlock system of the present invention.
Figure 9:
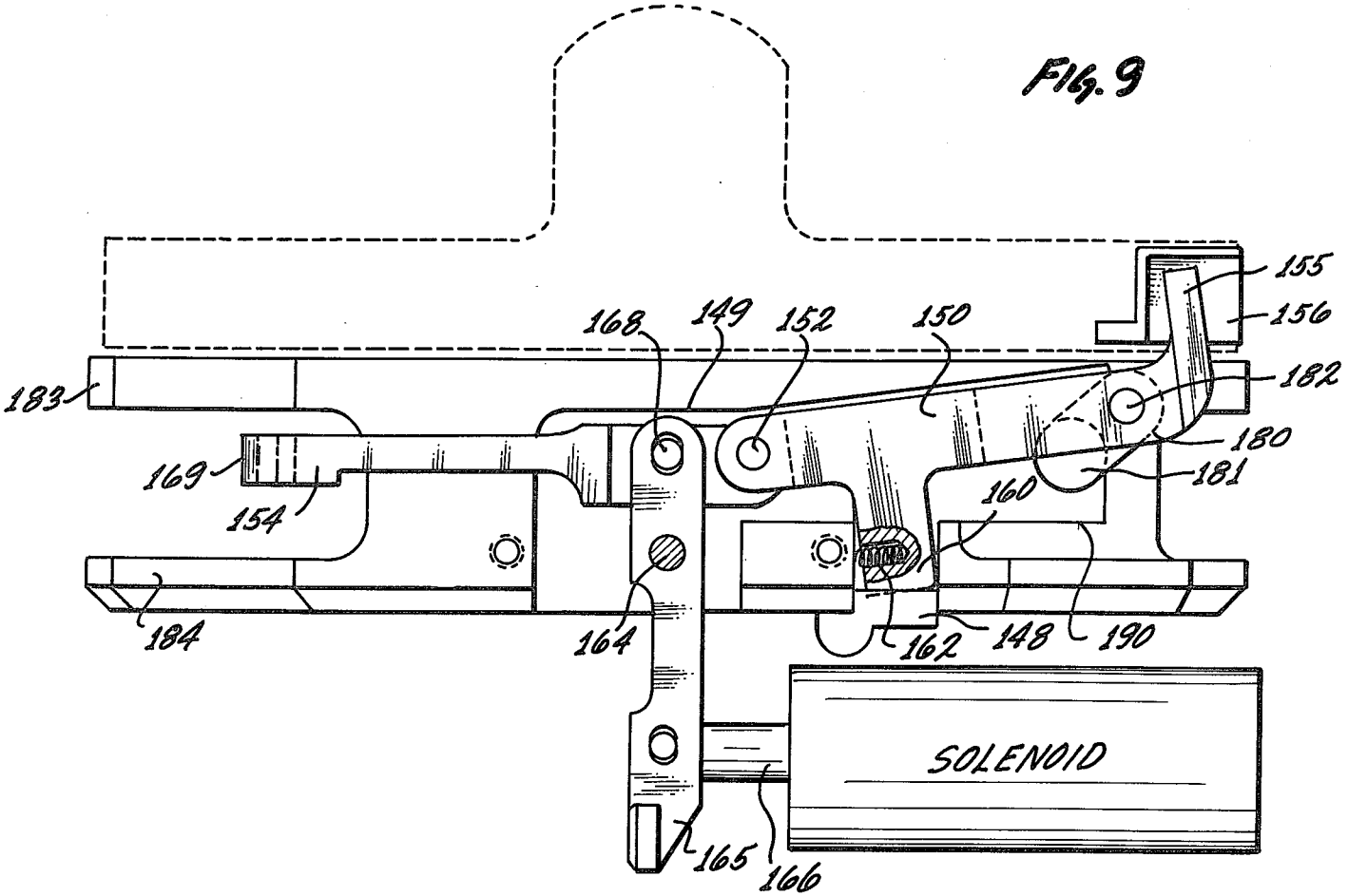
FIG. 9 is an end view, partly in elevation and partly in section of the mechanical interlock system of this invention.

Referring not to FIGS. 8–10, the details of the mechanical interlock system are shown and located in the lower portion and adjacent the rear wall of the receiver housing 130. At the barrel end of the receiver is an actuator rod assembly 131 including an acutator rod 132 seated for movement in a groove 133 in the base of the receiver housing. Cooperating with the rod 132 is a rocker 135 (FIG. 10) which is biased upwardly by spring 136 such that a rocker finger 137 is maintained in contact with the breech.

A rocker arm support rod 138 passes through the rocker 135 and is supported at one end in the receiver wall and at the end within the receiver wall, as shown. The support rod is of reduced thickness where it passes through the rocker and forms a pivot 140 about which the rocker rotates. The arm 142 of the rocker is bifurcated to engage a flat 144 on the end of the actuator rod 132.

During recoil, the breech moves to the rear with the barrel causing the rocker to rotate about pivot 140 moving the actuator rod 132 towards the barrel from its normal position as shown in FIG. 10. One end 145 of the actuator rod passes beneath a rear horn guide 147 and includes an inclined foot 148 which is also moved towards the barrel.

Mounted in a slot 149 (FIG. 9) forward in the rear face of the rear horn guide 147 which faces the rear wall of the receiver is a pushrod extension 150 which is pivotally mounted at 152 to a pushrod 154. The pushrod extension 150 includes a finger 155 which extends above the receiver wall for contact by a reset cam 156 carried on the bolt carrier, see FIGS. 2 and 4. As shown, the reset cam 156 is formed by a cam surface open at the rear and downwardly inclined toward the front, i.e. toward the barrel. The pushrod extension 150 also includes a pushrod extension foot 160 inclined to be complimentary with the shoe 148 of the actuator rod (FIG. 10). A spring 162 is received within the rear wall of the rear horn guide and also within an aperture 163 tending to urge the foot to the right as viewed in FIG. 9.

Also pivotally mounted at 164 to the rear wall of the receiver is a release link 165 one end of which is affixed by an oblong slot and to a solenoid plunger 166, and pivoted to the pushrod 154 at a pushrod-pushrod extension pivot 168 also in an oblong slot. The end 169 is connected to a pivotable sear assembly 170 (FIG. 8) which includes a sear 171 mounted in a sear rocker 172 the latter pivotable about pivot 173, the sear 171 being spring and shock mounted by a plurality of Belville springs 174. The sear rocker 172 is mounted to the pushrod 164 by a pin 176.

Also cooperating with the pushrod extension 150 is a crank 180 (FIG. 9) the latter being pivoted at one end 181 into the rear horn guide and at the other end 182 to the pushrod extension. As illustrated, the rear horn guide which guides the chain on its sprockets includes fingers 183, 184 through which the sear 171 may be pivoted to engage either the safety link or the master link. Not shown is a spring (corresponding to spring 107) located in the left side wall of the receiver which biases the sear assembly such that the sear 171 contacts the master link.

The latching mechanism includes basically the pushrod 132 and breech rocker 135 and the crank 180 and pushrod extension 150 and reset cam 156. As a general comment in understanding the interlock system, whenever the pushrod extension finger 155 is in the up position, the latching mechanism is in the released position. Accordingly, to understand the operation of the hangfire interlock system, various gun function modes are discussed as follows.

Assuming normal shut-down, i.e. a round has just been fired and the gun is in a normal cease fire condition, referring to FIG. 5 and FIGS. 8–10, the solenoid 100 is de-energized and in the extended position. Spring 107 biases the sear 171 into contact with the master link 31 since the pushrod 154 is biased to the right (as viewed in FIG. 9) and the sear assembly is pivoted around 173 in a clockwise direction (FIG. 8). The bolt and carrier are not quite to the fully retracted position and the reset cam 156 has not yet depressed the pushrod extension finger 155. The actuator rod 133 is to the rear such that show 148 is to the rear of the foot 160 (see FIG. 10.)

When the gun is activated, power is provided both to the motor 21 and to activate solenoid 100 (retracting the solenoid plunger), and release link 165 is rotated to the unsear position against the spring 107. Once the sear releases from the master link, the chain starts to move, retracting the bolt and carrier assembly and the reset cam 156 trips the pushrod extension finger 155 forcing it downwardly, as viewed in FIG. 9. The crank 180 acts as an over the center latch holding the pushrod extension down against the shoulder 190 in the rear horn guide, provided the solenoid is activated. The downward movement of the finger 155 overcomes the solenoid to place the sear into the sear position(the master link having passed) and the crank 180 operates to hold the interlock system in the latched condition. Since the actuator rod 132 is to the rear, the finger 155 can be depressed because the foot 160 clears the shoe 148.

Normal gun function continues, with the sear rotated to the engage position but not yet engaging either the safety link or master link, since neither of the latter have reached the sear.

As the master link reaches the bolt lock position (FIG. 5), the round is in the chamber and the bolt locked. If the chambered round fires properly the barrel and breech will recoil, tripping the rocker 137, urging the actuator rod toward the barrel and causing the shoe 148 to trip the foot 160, which rotates the pushrod extension upwardly around pivot 152 and releasing the crank 180. Since the solenoid is actuated, it moves the sear to the retracted or unsear position and the safety link passes the sear. Normal gun function then continues, i.e. the bolt is unlocked, coming to the rear and the bolt cam trips the finger 155 for the next sequence.

In the event of a hangfire, one of two things may take place. In the first, the bolt remains locked in the breech and if the round fires after the fire point (FIG. 5) but before or at the time the safety link reaches the sear in the sear position, normal gun function continues through the recoil sensing mechanism, as described. If, however, the round does not fire, the sear engages the safety link and gun function ceases. To restart the sequence, the gun operator releases the control mechanism which turns off all power to the gun. When this is done, the spring 107 maintains the sear engaged but the momentary deactivation of the solenoid permits the crank 180 to delatch by the action of spring 166 which pivots the pushrod extension upwardly to the release position. When the fire control mechanism is again engaged, the solenoid overcomes the sear spring, releasing the sear and gun function continues, as normal, with the dud round being ejected. As the bolt comes to the rear, the cam sets the finger 155 as described.

In a normal shut-down sequence, the solenoid is de-energized, and the sear spring is biased by spring 107 in the sear position to engage the master link. In dry cycling, the gun functions as if there were a hangfire, i.e. the sear engages the safety link and the stop-start sequence must be followed. The advantage is that the hangfire interlock can be checked by dry cycling. If the gun continues to cycle, there is a malfunction of the hangfire interlock system which should be corrected, if the hangfire interlock system is needed.

As noted during normal shut-down or hangfire shut-down, the chain is abruptly stopped to stop all gun function. Since the gun is externally powered through motor 21, an improved compact clutch gear assembly 45 is provided between the motor and can be de-clutched while permitting the motor to rotate until the internal motor brake functions to stop motor rotation.

Referring to FIG. 11, the compact and unique clutch gear assembly is illustrated and includes a gear 200 in the form of a bevel gear splined to drive shaft 202. The shaft 202 includes three slots 204 arranged at 120 degree spacing around the periphery of the shaft. Received in the slots are three roller bearings 205. Cooperating with the drive shaft 202 is a driven shaft 210 having a gear 212 thereon, the shaft 210 being hollow to receive shaft 202. Shaft 210 is also provided with slots 212 arranged at 120 degrees about the periphery. Thus, when positioned, the bearings 205 are seated in the slots 204 and 212 to connect the shafts 202 and 210 in driving relation.

Surrounding the shaft 210 is a machined spring 215, the spring being in the form of a cylinder with a helix 216 formed in it. The inner diameter of the spring 215 is so proportioned that it fits over shaft 210 to urge the roller bearings radially inwardly into the slots 212 and 204 to lock the shafts for rotation together. In the event that shaft 210 ceases to rotate, because of the stopping of some component driven by gear 212, the inner shaft 202 driven by the motor continues to rotate forcing the roller bearings outwardly through slots 212 against the spring 215 to expand the same, and declutching shafts 202 and 210 to permit the inner shaft to rotate relative to the outer shaft 210. In this mode, the bearings 205 are carried by the slots 212 and snap in and out of recesses 204 under the action of the spring 215 for as long as shaft 202 rotates relative to shaft 210. When shaft 120 is free to rotate again, the spring urges the bearings radially inwardly by seating in the slots 204 and 212 to drive the shafts together.

In the form illustrated, the gear clutch assembly de-clutches whenever the master link or safety link is engaged by the sear since gear 211 is driving gear 27 of the chain drive. As illustrated bearings 220 and 221 support shafts 202 and 210.

The clutch assembly shown in FIG. 11 and described herein is shown for purposes of illustration only, it being understood that other clutch arrangements may be used. The illustrated clutch assembly is the subject of a separate application, Ser. No. 046,665 filed of even date herewith and assigned to the same assignee.

It will be apparent to those skilled in the art that the above disclosure is for illustrative purposes and does not limit the present invention which is defined only by the following claims.

We claim:

1. In a gun which includes at least a feed mechanism, a gun barrel and a bolt and means to effect relative movement between the bolt and the barrel; and wherein the gun firing cycle includes ramming, locking the bolt, firing, unlocking the bolt, extracting, ejecting and feeding and wherein there is movement in recoil upon firing or a round, the improvement comprising:

chain means normally continuously moving during normal gun firing to effect movement of said bolt relative to said barrel, means to sense recoil as an indication that a round has fired, stop means engageable with said chain means to stop movement of said normally continuously moving chain means to thereby stop movement of said bolt, and means responsive to said sensing means to control movement of said stop means between an engaged position and a disengaged position.

2. A gun as set forth in claim 1, wherein said stop means is normally biased during gun operation to a position permitting movement of said normally continuous moving means, and wherein said responsive means is operative to maintain said stop means in the engaged position and to permit said stop means to move to the disengaged position as said sensing means detects recoil.

3. A gun as set forth in claim 1 wherein said sensing means controls the position of said stop means.

4. A gun as set forth in claim 1 wherein said stop means includes latch means operative to maintain said stop means in the engaged position during ramming and bolt locking and to maintain said stop means in the engaged position absent firing of a round to prevent unlocking of the bolt, and said latch means being operative in response to said sensing means to permit said stop means to move to the disengaged position in response to recoil thereby permitting the bolt to unlock, extract, feed, ram, lock and fire.

5. A gun as set forth in claim 1 wherein said stop means cycles from an engaged to a disengaged position upon firing of a round, but remains engaged to maintain the bolt in a locked position absent recoil.

6. A gun as set forth in claim 1 wherein said stop means includes a sear mechanism and a latch mechanism, said sear mechanism being moveable between a sear position to stop movement of said continuously moving means and to an unsear position permitting continuous movement of said continuously moving means, said latching mechanism having a latch and delatch position and being operative to maintain said sear mechanism in the sear position absent recoil and to permit movement of said sear to the unsear position upon the occurrence of recoil.

7. A gun as set forth in claim 6 wherein said sensing means is operative to switch said latch mechanism from the latch to the delatch position upon the occurrence of recoil.

8. A gun having a hangfire protection system, comprising:

a barrel moveable in recoil upon firing of a round, a bolt moveable toward and away from said barrel through a sequence of feeding, ramming, locking, firing, unlocking, ejecting, and extracting, means continuously moving during normal operation of said gun for effecting movement of said bolt in the ramming and extracting and ejecting sequence and continuously moving while said bolt is stationary during locking, firing, unlocking, and feeding means moveable between a first and second position and operative to stop movement of continuously moving means, means normally biasing said means to one of said positions during gun operation, latch means operative in a latched position to urge said means to one of said positions during at last ramming and bolt locking and operative in a delatched position to permit said biasing means to urge said means to the second position when a round has been fired, means responsive to barrel recoil to move said latch means to the unlatch position, and means operative in response to movement of said bolt to move said latch means to the latch position.

9. A gun as set forth in claim 8 wherein said means is a sear means, and wherein said latch means includes a pushrod operative in one position to urge said sear means into the sear position against said normally biasing means and in another position to permit said biasing means to urge said sear means into the sear position, pushrod extension means spring biased and operative in one position to move said pushrod into said one position and in a second position to move said pushrod into said other position, reset cam means responsive to movement of the bolt to urge said pushrod into said one position, crank means cooperating with said pushrod extension means to maintain said pushrod in said one position, and means responsive to barrel recoil to release said crank to permit said pushrod extension to move to said second position thereby permitting said pushrod to move to said other position permitting the sear means to move ot the unsear position through the action of said biasing means.

10. In an externally powered gun including a barrel, a bolt, drive means, normally moveable continuously in a predetermined path of travel and including predetermined regions at which bolt lock, firing and bolt unlock occurs, stop means operative in one position to engage said drive means to stop movement thereof and of said bolt after unlocking and before locking thereof and in a second position to permit continuous movement of said drive means, the improvement comprising a hangfire protection system including:

(a) safety stop means moveable in the same predetermined path of travel as said drive means and so located with respect thereto that as said drive means approaches the bolt unlock region said safety stop approaches said stop means, (b) means normally biasing said stop means to permit passage of said drive means, (c) means to latch said stop means to engage said safety stop prior to bolt unlock in the event of a failure of a round to fire within a predetermined period of time, (d) release means operative in response to firing of a round within said predetermined period of time to unlatch said stop means to permit passage of said safety means and unlock of the bolt through movement of said drive means, and (e) reset means to relatch said stop means after bolt unlock and before bolt lock.

11. A gun as set forth in claim 10 further including recoil sensing means operative to energize said release means.

12. A gun as set forth in claim 10 wherein said stop means is a sear moveable between a sear and unsear position, said drive means and said safety stop means being carried on a chain drive assembly such that once for each normal firing cycle of the gun each of the drive and safety stop pass the sear.

13. A gun as set forth in claim 12 further including means normally biasing the sear to the unsear position, said means to latch said stop means being operative in opposition to said biasing means, and said release means being operative to permit said biasing means to urge said sear to the unsear position.

14. A gun as set forth in claim 12 wherein said means to latch said stop means includes a crank means holding said sear in the sear position, and said release means being operative upon recoil to release said crank to unlatch said sear.

15. A gun as set forth in claim 10 wherein the period of time for travel of the drive means from the region of firing to bolt unlock is longer than the predetermined period of time within which the round normally fires.

16. A gun as set forth in claim 10 further including a chain drive assembly carrying both said drive means and said safety stop means, motor means, feed means including a continuously driven infeed mechanism and intermittently driven feed rotor to present a round sequentially to said bolt, gear means driven by said motor to drive said chain drive and feed means, clutch means between said motor and said gear means, and engagement of said safety stop means being operative to stop movement of said chain drive assembly and said feed mechanism and disengaging said clutch so that said motor continues to rotate.

17. A gun as set forth in claim 10 wherein upon hangfire, gun sequence is restarted after said predetermined period of time by releasing said biasing means to release said latch means.

18. A gun as set forth in claim 10 wherein said biasing means is an electrically operated solenoid, and wherein gun sequence after a hangfire is restarted by releasing said solenoid.

19. A gun as set forth in claim 16 wherein said gun is electrically powered and motor driven, said biasing means being an electrically operated solenoid, and wherein gun sequence after hangfire is restarted by momentarily turning off electrical power to said gun to momentarily de-energize said solenoid.

20. In an externally powered gun which includes a breech and barrel assembly, a bolt assembly moveable towards and away from said barrel and breech assembly, a continuously driven chain drive assembly including driving means for moving said bolt assembly, a feed assembly including a continuously driven infeed mechanism and an intermittently driven transfer mechanism to receive a round from said infeed mechanism and transfer it to said bolt assembly as the latter is in the rearward position of travel, a motor to effect movement of chain and feed assembly, clutch means operative to permit motor rotation when said chain and feed assembly are stopped said barrel having moveable in recoil upon firing, and wherein the gun firing cycle includes ramming, locking the bolt assembly, firing, unlocking the bolt assembly extracting and feeding, and wherein a sear mechanism, normally biased to the unsear position, is operative to engage the driving means of said chain assembly to stop movement thereof and of said feed assembly and said bolt assembly the improvement comprising:

a hangfire protection system including (a) means to sense the recoil of said barrel as an indication that a round has fired, (b) safety means so positioned in said chain drive assembly that as said driving means is operative to unlock said bolt assembly, said safety means in engagable by said sear mechanism to stop movement of said chain drive assembly which permitting said motor to continue to rotate (c) latch means operative in one position to urge said sear mechanism into engagement with said safety mechanism and in another position to permit said sear mechanism to move the unsear position, and (d) means to reset said latch as said bolt assembly moves away from said barrel.

* * * * *